US006578513B1

(12) United States Patent
Niksich

(10) Patent No.: US 6,578,513 B1
(45) Date of Patent: Jun. 17, 2003

(54) DEVICE FOR RECORDING AND DISPLAYING A TENNIS SCORE

(76) Inventor: Gene Niksich, 840 McFarland Rd., Alpharetta, GA (US) 30004

( * ) Notice: Subject to any disclaimer, the term of this patent is extended or adjusted under 35 U.S.C. 154(b) by 0 days.

(21) Appl. No.: 10/045,372

(22) Filed: Jan. 15, 2002

(51) Int. Cl.[7] ..... A63F 9/00
(52) U.S. Cl. ..... 116/222; 473/792; 473/459
(58) Field of Search ..... 116/222; 473/492, 473/459

(56) References Cited

U.S. PATENT DOCUMENTS

| | | | | | |
|---|---|---|---|---|---|
| D174,999 | S | * | 6/1955 | Schall | D10/46.1 |
| 4,331,098 | A | * | 5/1982 | Rubano | 116/222 |
| 4,557,215 | A | * | 12/1985 | Petersson | 116/222 |
| 4,712,504 | A | * | 12/1987 | Zarley et al. | 116/222 |
| 5,025,748 | A | * | 6/1991 | Pettis | 116/222 |
| 5,385,113 | A | | 1/1995 | Hierath | |
| D418,431 | S | * | 1/2000 | Niksich | D10/46.1 |

* cited by examiner

*Primary Examiner*—Diego Gutierrez
*Assistant Examiner*—Travis Reis
(74) *Attorney, Agent, or Firm*—Norman B. Rainer

(57) ABSTRACT

A tennis score keeping device includes a length of straight rigid plastic pipe having a closed upper extremity and open bottom extremity. A series of at least seven pairs of holes are disposed in the pipe in diametrically opposed relationship. Each hole has a diameter which can frictionally secure an inserted tennis ball. Numbers between one and seven are sequentially associated with each pair of holes to correspond to the game score. A tunnel extends between each pair of holes for the purpose of preventing tennis balls which are inserted too far into a hole from falling into the pipe. The pipe has a slot which permits mounting onto the post of a tennis net, and also has an aperture adjacent the upper extremity which enables the device to be hung on a fence.

8 Claims, 2 Drawing Sheets

DEVICE FOR RECORDING AND DISPLAYING A TENNIS SCORE

BACKGROUND OF THE INVENTION

1. Field of the Invention

This invention relates to score keeping for a tennis match, and more particularly concerns a device which may be located close to a tennis court for manual operation to record and display the games score of the current set.

2. Description of the Prior Art

In the game of tennis, a player or doubles team scores a point when the other side fails to return the ball properly. To win a game, one side must score at least four points. The accumulation of six games by one side constitutes a set. A match usually consists of winning two out of three sets.

The most commonly used technique of posting a tennis score involves a flip card device. In this technique, a T-bar score posting unit is mounted by its vertical member on one of the net posts, and a pair of sets of numbered flip cards are supported from a pair of opposite top cross members of the T-bar. Each flip card has a pair of small through-holes defined therethrough adjacent the top edge of the card. Metal rings are extended through these holes and disposed over the top cross members so as to support the sets of flip cards below the respective cross members of the T-bars. The numbers are printed in sequence on both front and back sides of the flip cards. The cards must be flipped over until the correct numbers are exposed to post the score.

Such flip card devices are tedious to use. The user has to lift each card to see if the number being sought is displayed on the opposite side of the current number being displayed. This creates some fumbling around to find and post the correct score. The flip cards themselves are subject to considerable wear and tear from frequent handling and weathering factors.

U.S. Pat. No. 5,385,113 to Hierath discloses a tennis score keeping device comprising an elongated vertically disposed display mast having a pair of opposite edge portions and a pair of opposite face portions. The face portions contain a sequence of vertically spaced numbers corresponding to the number of games won. A series of pockets is disposed in each edge portion in alignment with said numbers. In use, a tennis ball is pushed into the appropriate pocket along each edge of the mast. The pocket frictionally grips the ball, and the visually distinctive location of the ball indicates the score. Although convenient to use, the Hierath device is of complex construction, and its manner of fabrication predisposes it to deterioration by weathering factors.

The Hierath device is designed exclusively for mounting upon the post which supports the tennis net. However, said posts are not of standardized diameter or shape, and may not accommodate the Hierath device. Also, some organizations that own or operate tennis court facilities prohibit the mounting of upwardly directed devices upon the net-supporting posts. In such instances, the fencing that generally surrounds the tennis court is considered appropriate for the mounting of score keeping devices. The Hierath device cannot readily be operationally hung from fencing because the flat nature of its display mast leaves two little spacing from the fence to permit insertion of a tennis ball into the pockets in the edges of the mast.

It is accordingly an object of the present invention to provide a device for manually recording and displaying a tennis game score.

It is another object of this invention to provide a device as in the foregoing object which is easy to use.

It is a further object of the present invention to provide a device of the aforesaid nature which can be mounted either upon a post that supports a tennis net or upon a fence that surrounds a tennis court.

It is a still further object of this invention to provide a device of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a device for recording and displaying a tennis score, and attachable to a post which secures a cord that suspends a conventional tennis net, said device comprising:

a) a length of rigid plastic pipe having a sidewall of circular cylindrical cross-sectional configuration elongated upon a straight center axis between a closed upper extremity and open bottom extremity, b) a series of at least seven pairs of holes disposed within said sidewall in diametrically opposed juxtaposition on axes orthogonal to said center axis, said pairs of holes being equally spaced apart vertically along said center axis, each hole being of substantially circular shape having a diameter which permits frictional gripping of a standard tennis ball, c) a tunnel extending between the opposed holes of each pair of holes, d) visually distinctive indicia in the form of numerals from 1 to 7 sequentially arranged on said sidewall, each numeral associated with a pair of holes, e) attachment means for achieving securement of said pipe in vertically upright manner to said post, and f) mounting means adjacent said upper extremity to facilitate pendent securement of the device to a fence.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
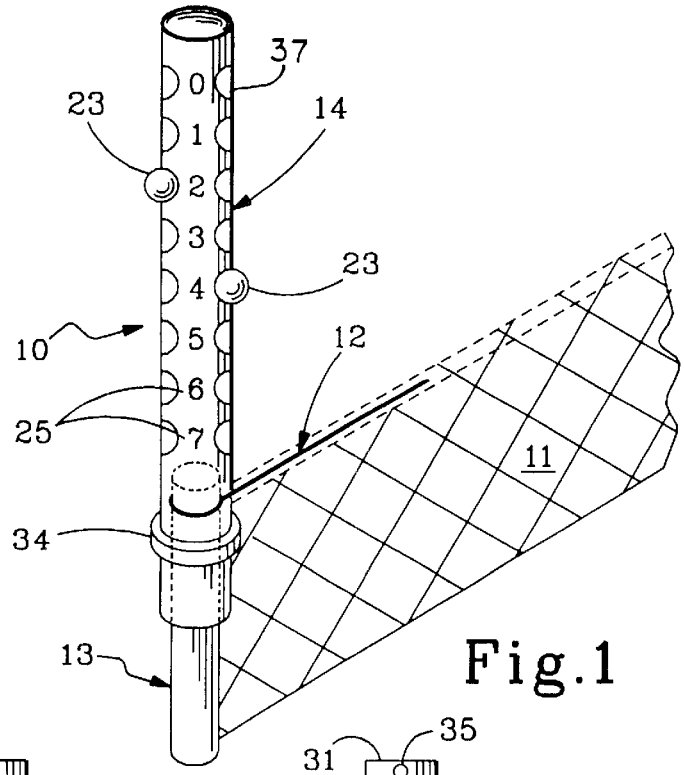
FIG. 1 is a front perspective view of an embodiment of the score keeping device of the present invention shown in association with a conventional tennis net.
Figure 2:
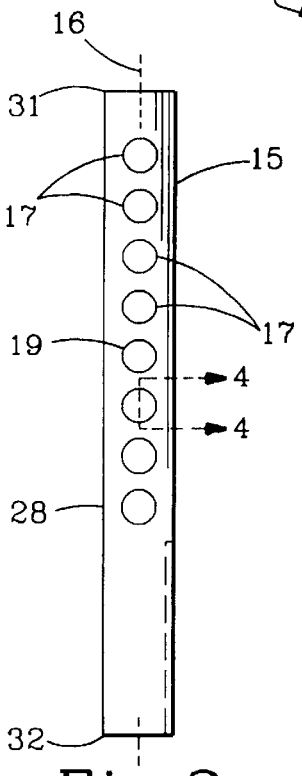
FIG. 2 is a side view of the embodiment of FIG. 1.
Figure 3:
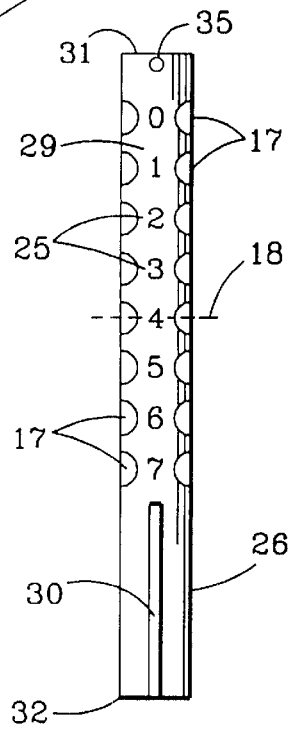
FIG. 3 is a rear view of the embodiment of FIG. 1.
Figure 4:
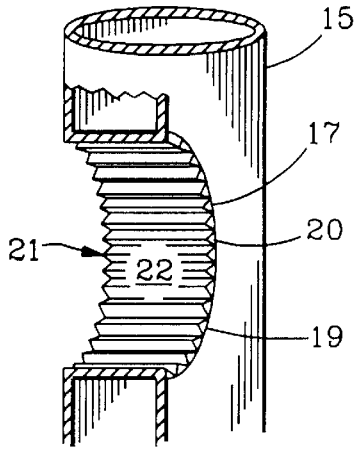
FIG. 4 is an enlarged fragmentary sectional view taken in the direction of the arrows upon the line 4—4 of FIG. 2.

Referring now to FIGS. 1–4, an embodiment of the score keeping device 10 of this invention is shown in association with a regulation size tennis net 11 tautly suspended by a cord 12 secured by post 13.

Device 10 is comprised of a length of rigid plastic pipe 14 having a sidewall 15 of circular cylindrical cross-sectional configuration. Said pipe is elongated upon a straight center axis 16, and has a length between about 4 and 7 feet, measured between closed upper extremity 31 and open bottom extremity 32. Said pipe is fabricated of a plastic resistant to outdoor weathering factors such as sunlight, precipitation and temperature extremes. Suitable plastics include thermoplastic polymers such as polyvinylchloride, polyethylene, polypropylene, and ABS (acrylonitrile-butadiene-styrene terpolymers), and condensation polymers such as polyamides and polyesters. The thickness of said sidewall is preferably between ⅛" and ⅜", and the inside diameter of the pipe is between about 2¾and 5". The pipe may be fabricated by way of extrusion or molding techniques which produce a smooth exterior surface 26.

A series of at least seven pairs of gripping holes 17 are disposed within said sidewall in diametrically opposed juxtaposition on axes 18 orthogonal to center axis 16, thereby forming two opposing vertical arrays of holes. The pairs of holes are equally spaced apart vertically along said center axis. Each hole is of substantially circular shape, having a diameter of about 2½", which permits frictional gripping of a standard tennis ball 23 pushed into the hole. The perimeter 19 of each hole is preferably provided with gripping means such as an array of teeth 20.

A tunnel 21 extends between the opposed holes of each pair of holes. The tunnel may be comprised of a circuitous wall 22 having substantially the same diameter as associated holes 17, or may be a discontinuous series of rods or equivalent structures. The function of the tunnel is to prevent a tennis ball from passing entirely through a hole 17 and falling to the bottom interior of pipe 14.

Visibly distinctive indicia 25 in the form of numerals from 1 to 7 are sequentially arranged on exterior surface 26, each numeral being associated with a pair of holes. Said indicia may be in the form of painted figures, adhered and upraised decals, or inwardly recessed or etched markings. The numerals preferably appear on diametrically opposed locations of the pipe, which may be considered front and rear portions 28 and 29, respectively. Said indicia, in conjunction with the associated gripping holes 17 keep track of the game score. An additional pair of holes 37, preferably located above the seven holes devoted to the game score, may be employed for recording the set score.

Attachment means in the form of slot 30 is associated with rear surface 29. Said slot opens onto bottom extremity 32 of the pipe, and is adapted to accommodate cord 12 as the open lower extremity of the pipe receives post 13. Auxiliary attachment means in the form of pipe clamp 34 may be employed to encircle both post 13 and pipe 14.

Figure 5:
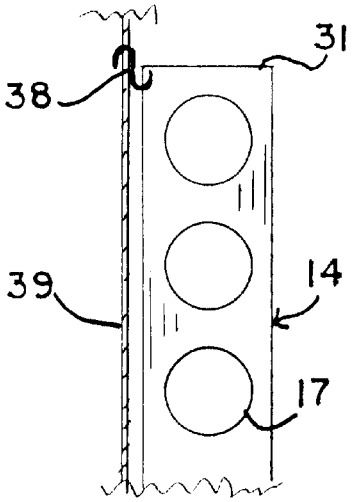
FIG. 5 is an enlarged fragmentary side view showing said device in association with a fence.
Figure 6:
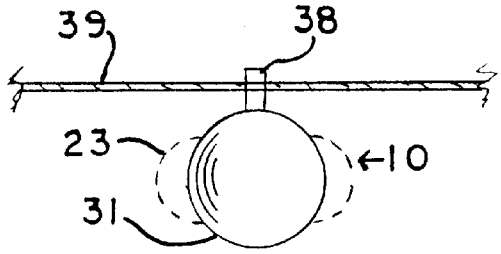
FIG. 6 is a top view corresponding to FIG. 5.

Mounting means in the form of aperture 35 may be provided in the rear surface of said sidewall adjacent upper extremity 31. Such mounting means may be employed to suspend the scoring device from a fence adjacent the tennis court, instead of mounting the device on the post of a tennis net. As best shown in FIGS. 5 and 6, a standard S-hook 38 may be employed to engage aperture 35, and further engage the fence 39. A second aperture may be located adjacent bottom extremity 32 for additional securement to a fence.

In use, a tennis ball is inserted into a hole corresponding to a game score in one of the vertical arrays of holes. The opposite array is utilized by the other player. With each change in score, the ball is repositioned to the appropriate hole within the same array.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A device for recording and displaying a tennis score, and attachable to a post which secures a cord that suspends a conventional tennis net, said device comprising:

a) a length of rigid plastic pipe having a sidewall of circular cylindrical cross-sectional configuration elongated upon a straight center axis between a closed upper extremity and open bottom extremity, and having an inside diameter greater than 2¾ inch, b) a series of at least seven pairs of holes disposed within said sidewall in diametrically opposed juxtaposition on axes orthogonal to said center axis, said pairs of holes being equally spaced apart vertically along said center axis, each hole being of substantially circular shape having a diameter which permits frictional gripping of a standard tennis ball, c) a tunnel extending between the opposed holes of each pair of holes, d) visually distinctive indicia in the form of numerals from 1 to 7 sequentially arranged on said sidewall, each numeral associated with a pair of holes, e) attachment means for achieving securement of said pipe in vertically upright manner to said post, and f) mounting means adjacent said upper extremity to facilitate pendent securement of the device to a fence.

2. The device of claim 1 wherein said holes are arranged such as to form two opposing vertical arrays of holes, thereby defining side portions of said sidewall and consequent front and rear portions of said sidewall.

3. The device of claim 2 wherein said indicia is disposed upon both front and rear portions of said sidewall.

4. The device of claim 2 wherein said attachment means comprises a slot in said rear surface which opens onto said bottom extremity.

5. The device of claim 4 wherein said mounting means is comprised of at least one aperture in the rear portion of said sidewall.

6. The device of claim 1 wherein each hole has a perimeter provided with means for gripping a tennis ball.

7. The device of claim 6 wherein said gripping means is comprised of an array of teeth.

8. The device of claim 1 wherein said tunnel is comprised of a circuitous wall having substantially the same diameter as the associated holes.

* * * * *